US006196813B1

(12) United States Patent
Turley et al.

(10) Patent No.: US 6,196,813 B1
(45) Date of Patent: Mar. 6, 2001

(54) PUMP ASSEMBLY INCLUDING INTEGRATED ADAPTER

(75) Inventors: Roger Scott Turley, Springboro; Frederick Dague Hery, Franklin; Frank Edward Stauble, Beavercreek, all of OH (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/347,750

(22) Filed: Jul. 6, 1999

(51) Int. Cl.[7] ..... F04B 17/00

(52) U.S. Cl. ..... 417/423.12; 417/360; 417/423.1; 417/423.11; 417/423.12

(58) Field of Search ..... 417/360, 423.1, 417/423.12, 423.14, 423.11

(56) References Cited

U.S. PATENT DOCUMENTS

| | | | |
|---|---|---|---|
| 2,849,959 | 9/1958 | Murphy . | |
| 3,526,469 | 9/1970 | Lipe et al. . | |
| 3,746,472 | 7/1973 | Rupp . | |
| 3,961,641 | 6/1976 | Tyson . | |
| 4,183,543 | 1/1980 | Antonini . | |
| 4,509,773 | 4/1985 | Wentworth . | |
| 4,512,725 | 4/1985 | Saulgeot . | |
| 4,575,306 | 3/1986 | Monnot . | |
| 4,810,174 * | 3/1989 | Stuckey et al. | 417/423.14 |

(List continued on next page.)

FOREIGN PATENT DOCUMENTS

| | | |
|---|---|---|
| 14 53 717 | 1/1969 | (DE) . |
| 22 06 398 | 8/1973 | (DE) . |
| 28 12 809 | 9/1979 | (DE) . |
| 37 18 560 | 12/1988 | (DE) . |

OTHER PUBLICATIONS

Brochure entitled "The GF–200 Dura Seal" Durametallic Corporation, 1995.
Bulletin P–10–500b(E) "Durco Mark III Ansi Process Pumps" Flowserve Corporation, Aug. 1998, pp. 1–36.
Bulletin P–25–100(E) "Pump Products" Flowserve Corporation, Dec. 1998, pp. 1–32.

* cited by examiner

*Primary Examiner*—Teresa Walberg
*Assistant Examiner*—Jeffery Pwu
(74) *Attorney, Agent, or Firm*—Killworth, Gottman, Hagan & Schaeff, L.L.P.

(57) ABSTRACT

A pump assembly is provided including a motor, a motor housing, a dual-bearing rotational drive assembly, an integrated adapter, a pump housing, a seal assembly, and an impeller. In accordance with one embodiment of the present invention, the dual-bearing rotational drive assembly comprises a drive shaft and first and second bearings. The motor housing is disposed about the motor and defines a front end and a rear end. The pump housing is disposed about the impeller. The integrated adapter is arranged to couple mechanically the rear end of the motor housing to the pump housing. The motor is arranged to impart rotational movement to the drive shaft about a drive shaft axis. The drive shaft is coupled to the impeller such that rotation of the drive shaft causes rotation of the impeller. The drive shaft defines a first end disposed proximate the front end of the motor housing and a second end disposed proximate the impeller such that the drive shaft extends from the front end of the motor housing, through the rear end of the motor housing, and to the pump housing. The first rotational support is arranged proximate the front end of the motor housing. The second rotational support is accommodated by the integrated adapter. The pump assembly is arranged such that the drive shaft and the first and second rotational supports define a rotational drive assembly characterized by the absence of additional rotational support between the first rotational support proximate the front end of the motor housing and the second rotational support accommodated by the integrated adapter.

18 Claims, 2 Drawing Sheets

U.S. PATENT DOCUMENTS

| | | | | |
|---|---|---|---|---|
| 4,966,532 | | 10/1990 | Fengsheng . | |
| 5,004,942 | | 4/1991 | King . | |
| 5,178,523 | | 1/1993 | Cheng-Chung . | |
| 5,193,977 | * | 3/1993 | Dame | 415/206 |
| 5,308,229 | | 5/1994 | DuPuis et al. . | |
| 5,326,235 | | 7/1994 | Bruhn . | |
| 5,340,273 | | 8/1994 | Rockwood . | |
| 5,344,291 | | 9/1994 | Antkowiak . | |
| 5,370,509 | | 12/1994 | Golding et al. . | |
| 5,427,501 | * | 6/1995 | Chu | 415/143 |
| 5,478,222 | | 12/1995 | Heidelberg et al. . | |
| 5,482,432 | * | 1/1996 | Paliwoda et al. | 415/168.2 |
| 5,498,007 | | 3/1996 | Kulkarni et al. . | |
| 5,499,902 | | 3/1996 | Rockwood . | |
| 5,501,580 | * | 3/1996 | Barrus et al. | 417/410.3 |
| 5,525,039 | * | 6/1996 | Sieghartner | 417/32 |
| 5,531,458 | | 7/1996 | Sedy . | |
| 5,533,739 | | 7/1996 | Sedy . | |
| 5,553,867 | | 9/1996 | Rockwood . | |
| 5,556,111 | | 9/1996 | Sedy . | |
| 5,564,914 | | 10/1996 | Kobayashi et al. . | |
| 5,567,133 | | 10/1996 | Kobayashi et al. . | |
| 5,702,110 | | 12/1997 | Sedy . | |
| 5,722,665 | | 3/1998 | Sedy et al. . | |
| 5,727,792 | | 3/1998 | Rockwood . | |
| 5,742,109 | | 4/1998 | Volz et al. . | |
| 5,747,905 | | 5/1998 | Yabushita et al. . | |
| 5,823,752 | | 10/1998 | Hoenisch et al. . | |
| 5,854,522 | | 12/1998 | Iwata et al. . | |
| 5,894,180 | | 4/1999 | Volz et al. . | |
| 5,924,697 | | 7/1999 | Parker et al. . | |
| 6,071,092 | * | 6/2000 | Casaro et al. | 417/423.4 |

PUMP ASSEMBLY INCLUDING INTEGRATED ADAPTER

BACKGROUND OF THE INVENTION

The present invention relates to enhancing durability and reliability of a pump and, more particularly, to a pump assembly including an integrated adapter arranged to align the motor drive shaft and secure a motor housing to an associated pump housing.

There is a continuing drive in pump design and manufacture to enhance reliability and durability by extending bearing and seal life. Conventionally, bearing and seal life are extended by providing heavy duty components and ensuring precision manufacture. Specifically, heavy duty shafts, bearings, and seals are commonly incorporated into the pump design. For example, according to conventional motor-driven pump designs, two bearing assemblies are provided on opposite ends of a drive shaft in the motor housing. In addition, supplemental or additional rotational supports are arranged about the drive shaft between the motor housing and the pump housing. Practical limits on motor housing size and manufacturing costs limit the commercial effectiveness of pump design strategies that merely seek to extend bearing and seal life by increasing the durability of individual components or by providing additional heavy duty components. Accordingly, there is a need for a pump design that enhances pump reliability and durability without relying solely upon selection of the most rugged components or on provision of additional components.

BRIEF SUMMARY OF THE INVENTION

This need is met by the present invention wherein a pump assembly is provided comprising a motor, a motor housing, a dual-bearing rotational drive assembly, an integrated adapter, a pump housing, and an impeller.

In accordance with one embodiment of the present invention, a pump assembly is provided comprising a motor, a motor housing, a drive shaft, a first rotational support, a second rotational support, an integrated adapter, a pump housing, a seal assembly, and an impeller. The motor housing is disposed about the motor and defines a front end and a rear end. The pump housing is disposed about the impeller. The integrated adapter is arranged to couple mechanically the rear end of the motor housing to the pump housing. The motor is arranged to impart rotational movement to the drive shaft about a drive shaft axis. The drive shaft is coupled to the impeller such that rotation of the drive shaft causes rotation of the impeller. The drive shaft defines a first end disposed proximate the front end of the motor housing and a second end disposed proximate the impeller such that the drive shaft extends from the front end of the motor housing, through the rear end of the motor housing, and to the pump housing. The first rotational support is arranged proximate the front end of the motor housing. The second rotational support is accommodated by the integrated adapter. The pump assembly is arranged such that the drive shaft and the first and second rotational supports define a rotational drive assembly characterized by the absence of additional rotational support between the first rotational support proximate the front end of the motor housing and the second rotational support accommodated by the integrated adapter.

The pump assembly is preferably characterized by no more than two points of rotational support along the drive shaft. The first and second rotational supports preferably comprise bearings and the rotational drive assembly may be characterized by the absence of additional bearings between the first rotational support and the second rotational support. The first rotational support is preferably disposed within the motor housing and may comprise a radial bearing. The second rotational support comprises a combination radial bearing and axial thrust bearing.

The integrated adapter is preferably mounted to the motor housing and to the pump housing and may accommodate an axial adjustment mechanism arranged to adjust an axial position of the second rotational support along the drive shaft axis. The axial adjustment mechanism may comprise a threaded support housing and at least one set screw. The threaded support housing is preferably arranged to engage a complementary receiving thread formed in the integrated adapter and the threaded support housing and the complementary receiving thread are arranged about the drive shaft axis.

The second rotational support is arranged such that axial movement of the second rotational support results in axial movement of the drive shaft, and wherein the drive shaft is coupled to the impeller such that axial movement of the drive shaft results in axial movement of the impeller. The motor housing, the pump housing, and the integrated adapter preferably comprise separate components of the pump assembly, and the integrated adapter is arranged to couple the motor housing to the pump housing such that the motor housing, the pump housing, and the integrated adapter form a unitary assembly.

In accordance with another embodiment of the present invention, a pump assembly is provided comprising a motor, a motor housing, a drive shaft, an integrated adapter, a pump housing, a seal assembly, and an impeller. The motor housing includes no more than one rotational support disposed therein and the integrated adapter is arranged to accommodate an additional rotational support such that the drive shaft, the one rotational support, and the additional rotational support define a rotational drive assembly supported proximate the first drive shaft end by the one rotational support and proximate the second drive shaft end by the additional rotational support.

In accordance with yet another embodiment of the present invention, a pump assembly is provided comprising a motor, a motor housing, a dual-bearing rotational drive assembly, an integrated adapter, a pump housing, a seal assembly, and an impeller. The dual-bearing rotational drive assembly comprises a drive shaft and first and second bearings. The drive shaft extends from the front end of the motor housing, through the rear end of the motor housing, and to the pump housing. The first bearing is arranged proximate the front end of the motor housing. The second bearing is accommodated by the integrated adapter.

Accordingly, it is an object of the present invention to provide a pump design that enhances pump reliability and durability without relying solely upon selection of the most rugged components or on provision of additional components. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
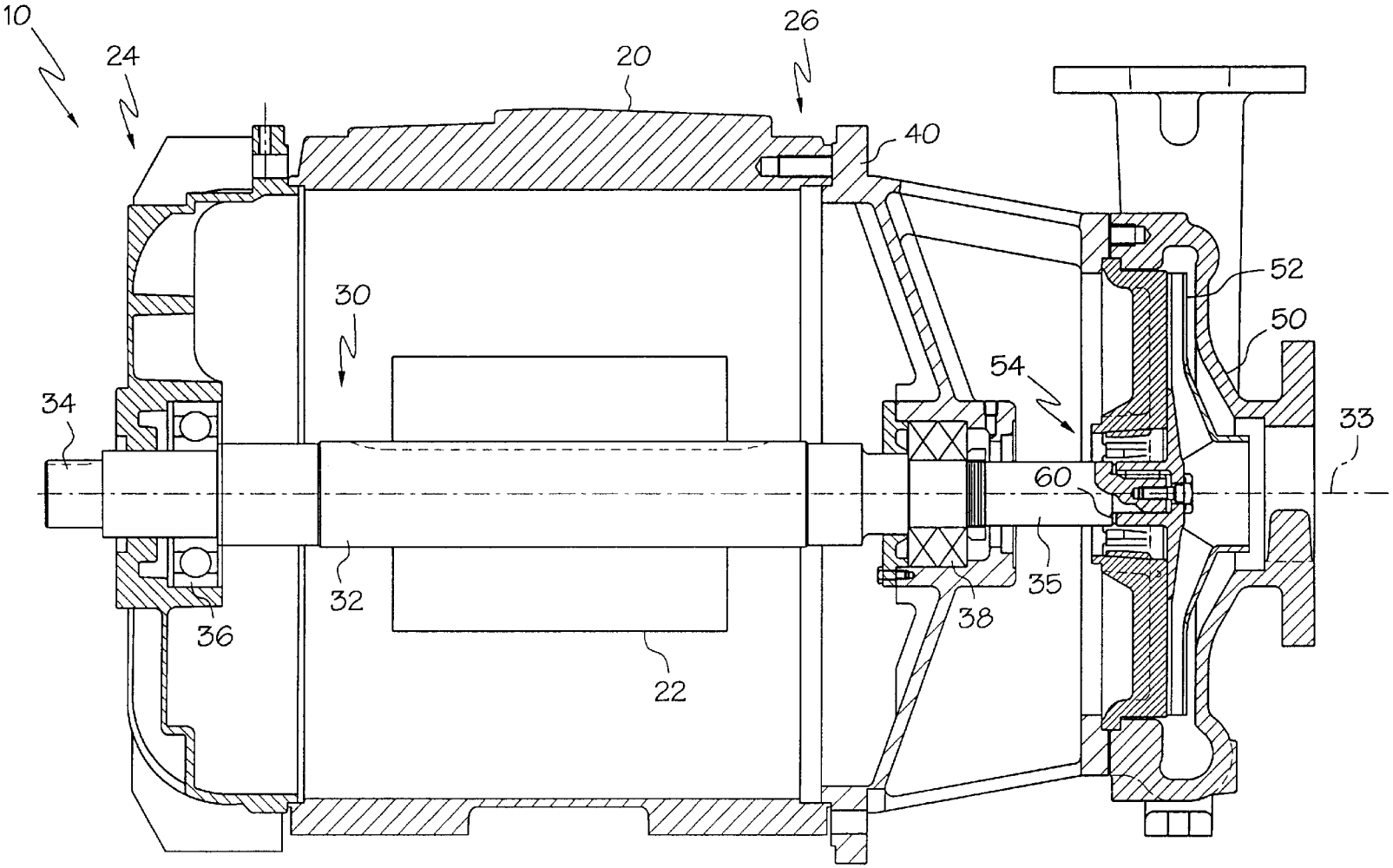
FIG. 1 is an illustration, partially in cross section, of a pump assembly according to the present invention.

Referring initially to FIG. 1, a pump assembly 10 according to the present invention comprises a motor housing 20, a motor 22, a dual-bearing rotational drive assembly 30, an integrated adapter 40, a pump housing 50, an impeller 52, and a seal assembly 54. The motor housing 20 is disposed about the motor 22 and defines a front end 24 and a rear end 26. Similarly, the pump housing 50 is disposed about the impeller 52. The dual-bearing rotational drive assembly 30 includes a drive shaft 32, a first rotational support 36, and a second rotational support 38. For the purposes of describing and defining the present invention, a rotational support covers all types of structure the primary function of which is to support the drive shaft 32, axially or radially, and allow the drive shaft 32 to rotate about a drive shaft axis 33. For example, the rotational supports 36, 38 may comprise bearings (ball bearings, sleeve bearings, thrust bearings, etc.) or any other structure arranged to function in a like manner. The rotational supports 36, 38 do not comprise structure that is merely presented to function as a seal or sealing assembly.

The motor housing 20, the pump housing 50, and the integrated adapter 40 comprise separate components of the pump assembly 10. The integrated adapter 40 is mounted to the motor housing 20 and to the pump housing 50 and is arranged to couple mechanically the rear end 26 of the motor housing 20 to the pump housing 50. In this manner, the motor housing 20, the pump housing 50, and the integrated adapter 40 form a unitary assembly. It is contemplated that the adapter can be jacketed for water cooling circulation in high temperature applications.

The motor 22, illustrated schematically in FIG. 1, is arranged to impart rotational movement to the drive shaft 32 about the drive shaft axis 33. The drive shaft 32 is coupled to the impeller 52 such that rotation of the drive shaft 32 causes rotation of the impeller 52. The drive shaft 32 defines a first end 34 disposed proximate the front end 24 of the motor housing 20 and a second end 35 disposed proximate the impeller 52 such that the drive shaft 32 extends from the front end 24 of the motor housing 20, through the rear end 26 of the motor housing 20, and to the pump housing 50. The drive shaft 32 may comprise a butt-welded dual material shaft or a single material shaft.

The first rotational support 36 comprises a radial bearing assembly and is disposed within the motor housing 20 proximate the front end 24 of the motor housing 20. In the illustrated embodiment, the motor housing 20 includes no more than one rotational support disposed therein. The second rotational support 38 comprises a combination radial bearing and axial thrust bearing and is accommodated by the integrated adapter 40. For the purposes of defining and describing the present invention, it is noted that an axial thrust bearing functions to limit axial motion of a rotating shaft and that a radial bearing, also known as journal bearing, functions to support a rotating shaft and a radial load.

The pump assembly 10 is arranged such that the drive shaft 32 and the first and second rotational supports 36, 38 define a dual-bearing rotational drive assembly 30 characterized by the absence of additional rotational support between the first rotational support 36 proximate the front end 24 of the motor housing 20 and the second rotational support 38 accommodated by the integrated adapter 40. In contrast, according to the conventional pump designs described above, two bearing assemblies are arranged on opposite ends of a drive shaft in a motor housing and additional rotational supports are provided between the motor housing and an associated pump housing.

According to the illustrated embodiment of the present invention, the second rotational support 38 effectively replaces the conventional bearing assembly at the rear end of the motor housing, as described above, and only two points of rotational support are provided along the drive shaft 32. In this manner, those practicing the present invention may select or design the additional rotational support 38 independent of the design constraints imposed by the motor 22 and the motor housing 20. In addition, by limiting the number of rotational supports arranged along the drive shaft 32, it becomes easier to align the drive shaft 32 within the pump assembly 10 and the drive shaft 32 may be aligned more accurately.

It is important to note that the design of the present invention enables a designer to minimize the distance between the impeller 52 and the second rotational support 38 because the second rotational support 38 is no longer positioned within the motor housing 20. This minimized distance in turn minimizes radial deflection of the drive shaft 32 at the seal assembly 54 of the pump housing 50, thus decreasing seal assembly wear. In addition, the integrated adapter of the present invention reduces the number of precision manufactured components in the overall design of the pump assembly. As a result, there are less components to manufacture and fewer manufacturing tolerances to take into account. Finally, the integrated adapter replaces the conventional adapter end plate bolted combination with a single solid component, i.e., the integrated adapter, further reducing operational error and improving the rigidity of the design.

Figure 2:
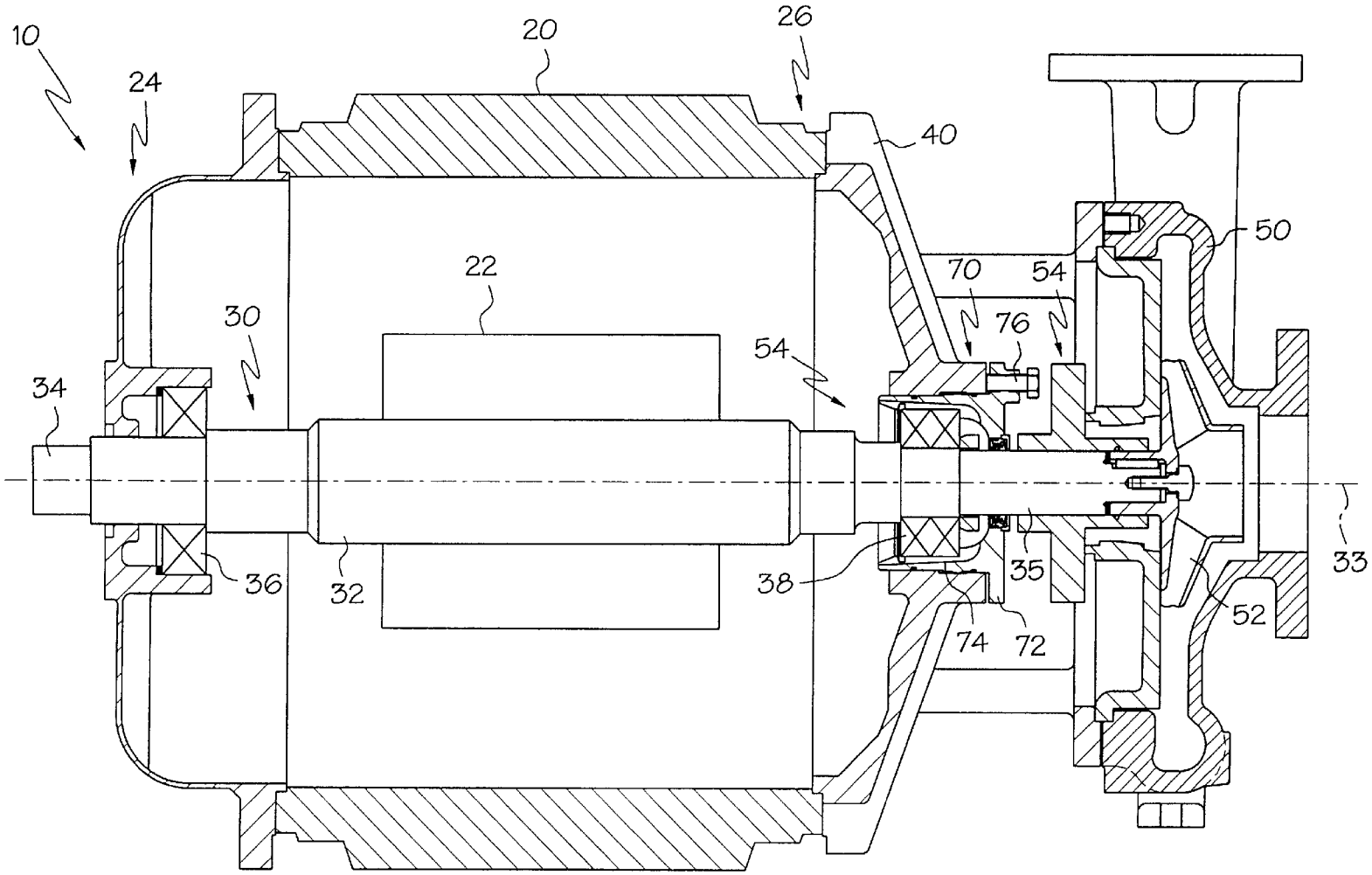
FIG. 2 is an illustration, partially in cross-section, of a pump assembly including an axial adjustment mechanism according to the present invention.

In the embodiment illustrated in FIG. 1, shims 60 are utilized to adjust impeller clearance. Referring now to the embodiment of the present invention illustrated in FIG. 2, where like structure is indicated with like reference numerals, the drive shaft 32 comprises a butt-welded dual material shaft and the shims 60 are eliminated. The integrated adapter 40 further accommodates an axial adjustment mechanism 70 arranged to adjust the axial position of the second rotational support 38 along the drive shaft axis 33. The axial adjustment mechanism 70 comprises a threaded support housing 72 arranged to engage a complementary receiving thread 74 formed in the integrated adapter 40. The threaded support housing 72 and the complementary receiving thread 74 are arranged about the drive shaft axis 33. The position of the second rotational support 38 along the drive shaft axis 33 is adjusted by rotating the threaded support housing 72 and is fixed by engaging one or more set screws 76 provided in the threaded support housing 72. Axial movement of the second rotational support 38 results in axial movement of the drive shaft 32 and, because the drive shaft 32 is coupled to the impeller 52, axial movement of the drive shaft 32 results in axial movement of the impeller 52 or adjustment of impeller clearance.

Having described the invention in detail and by reference to preferred embodiments thereof, it will be apparent that modifications and variations are possible without departing from the scope of the invention defined in the appended claims. For example, it is contemplated by the present invention that a variety of specific commercially available seal and bearing assemblies may be utilized without departing from the scope of the present invention. It is further contemplated that similar latitude is attributable to the specific design of the particular bearing assemblies, drive shaft, and other assembly components utilized in practicing the invention defined in the appended claims. Suitable seal assemblies include virtually any single mechanical face seal design and most double seal designs, as available from Flowserve Corporation, Irving, Tex. Suitable bearing assemblies include single and double row deep groove ball bearings with integral shields or seals in conjunction with labyrinth motor seals, as available from NTN Bearing Corporation, Mount Prospect, Ill., and SKF Bearing Industries. Suitable drive shafts include friction welded carbon steel drive shafts or stainless steel drive shafts, as available from the Flowserve Corporation. Suitable motor units may be selected from any of the electric motor units available from the Flowserve Corporation. Suitable pump units include vertical and horizontal cantilevered impeller pumps, as available from the Flowserve Corporation

What is claimed is:

1. A pump assembly comprising a motor, a motor housing, a drive shaft, a first rotational support, a second rotational support, an integrated adapter, a pump housing, a seal assembly, and an impeller, wherein:

said motor housing is disposed about said motor and defines a front end and a rear end;

said pump housing is disposed about said impeller;

said integrated adapter is arranged to couple mechanically said rear end of said motor housing to said pump housing;

said motor is arranged to impart rotational movement to said drive shaft about a drive shaft axis;

said drive shaft is coupled to said impeller such that rotation of said drive shaft causes rotation of said impeller;

said drive shaft defines a first end disposed proximate said front end of said motor housing and a second end disposed proximate said impeller such that said drive shaft extends from said front end of said motor housing, through said rear end of said motor housing, and to said pump housing;

said first rotational support is arranged proximate said front end of said motor housing;

said second rotational support is accommodated by said integrated adapter;

said pump assembly is arranged such that said drive shaft and said first and second rotational supports define a rotational drive assembly characterized by the absence of additional rotational support between said first rotational support proximate said front end of said motor housing and said second rotational support accommodated by said integrated adapter.

2. A pump assembly as claimed in claim 1 wherein said pump assembly is further characterized by no more than two points of rotational support along said drive shaft.

3. A pump assembly as claimed in claim 1 wherein said first rotational support is disposed within said motor housing.

4. A pump assembly as claimed in claim 1 wherein said first rotational support comprises a radial bearing.

5. A pump assembly as claimed in claim 1 wherein said second rotational support comprises a combination radial bearing and axial thrust bearing.

6. A pump assembly as claimed in claim 1 wherein said first and second rotational supports comprise bearings and wherein said rotational drive assembly is characterized by the absence of additional bearings between said first rotational support and said second rotational support.

7. A pump assembly as claimed in claim 1 wherein said integrated adapter is mounted to said motor housing and to said pump housing.

8. A pump assembly as claimed in claim 1 wherein said integrated adapter further accommodates an axial adjustment mechanism arranged to adjust an axial position of said second rotational support along said drive shaft axis.

9. A pump assembly as claimed in claim 8 wherein said axial adjustment mechanism comprises a threaded support housing and at least one set screw.

10. A pump assembly as claimed in claim 8 wherein said axial adjustment mechanism comprises a threaded support housing, wherein said threaded support housing is arranged to engage a complementary receiving thread formed in said integrated adapter, and wherein said threaded support housing and said complementary receiving thread are arranged about said drive shaft axis.

11. A pump assembly as claimed in claim 8 wherein said second rotational support is arranged such that axial movement of said second rotational support results in axial movement of said drive shaft, and wherein said drive shaft is coupled to said impeller such that axial movement of said drive shaft results in axial movement of said impeller.

12. A pump assembly as claimed in claim 1 wherein said motor housing, said pump housing, and said integrated adapter comprise separate components of said pump assembly, and wherein said integrated adapter is arranged to couple said motor housing to said pump housing such that said motor housing, said pump housing, and said integrated adapter form a unitary assembly.

13. A pump assembly comprising a motor, a motor housing, a drive shaft, an integrated adapter, a pump housing, a seal assembly, and an impeller, wherein:

said motor housing is disposed about said motor;

said pump housing is disposed about said impeller;

said integrated adapter is arranged to couple mechanically said motor housing to said pump housing;

said drive shaft defines a drive shaft axis, a first end disposed proximate said motor, and a second end disposed proximate said impeller;

said motor is arranged to impart rotational movement to said drive shaft about said drive shaft axis;

said drive shaft is coupled to said impeller such that rotation of said drive shaft causes rotation of said impeller;

said motor housing includes no more than one rotational support disposed therein;

said integrated adapter s arranged to accommodate an additional rotational support such that said drive shaft, said one rotational support, and said additional rotational support define a rotational drive assembly supported proximate said first drive shaft end by said one rotational support and proximate said second drive shaft end by said additional rotational support.

14. A pump assembly as claimed in claim 13 wherein said integrated adapter further accommodates an axial adjustment mechanism arranged to adjust an axial position of said additional rotational support along said drive shaft axis.

15. A pump assembly as claimed in claim 14 wherein said second rotational support is arranged such that axial movement of said additional rotational support results in axial movement of said drive shaft, and wherein said drive shaft is coupled to said impeller such that axial movement of said drive shaft results in axial movement of said impeller.

16. A pump assembly comprising a motor, a motor housing, a dual-bearing rotational drive assembly, an integrated adapter, a pump housing, a seal assembly, and an impeller, wherein:

said motor housing is disposed about said motor and defines a front end and a rear end;

said pump housing is disposed about said impeller;

said integrated adapter is arranged to couple mechanically said rear end of said motor housing to said pump housing;

said motor is arranged to impart rotational movement to said rotational drive assembly about a drive shaft axis;

said drive shaft is coupled to said impeller such that rotation of said drive shaft causes rotation of said impeller; and said dual-bearing rotational drive assembly comprises a drive shaft defining a first end disposed proximate said front end of said motor housing and a second end disposed proximate said impeller such that said drive shaft extends from said front end of said motor housing, through said rear end of said motor housing, and to said pump housing, a first bearing arranged proximate said front end of said motor housing, and a second bearing accommodated by said integrated adapter.

17. A pump assembly as claimed in claim 16 wherein said integrated adapter further accommodates an axial adjustment mechanism arranged to adjust an axial position of said second bearing along said drive shaft axis.

18. A pump assembly as claimed in claim 17 wherein said second bearing is arranged such that axial movement of said second rotational support results in axial movement of said drive shaft, and wherein said drive shaft is coupled to said impeller such that axial movement of said drive shaft results in axial movement of said impeller.

* * * * *

UNITED STATES PATENT AND TRADEMARK OFFICE

CERTIFICATE OF CORRECTION

PATENT NO. : 6,196,813 B1
DATED : March 6, 2001
INVENTOR(S) : Turley et al.

It is certified that error appears in the above-identified patent and that said Letters Patent is hereby corrected as shown below:

Column 6,
Line 49, "adapter s" should read -- adapter is --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*